US006082744A

United States Patent [19]

Allinger et al.

[11] Patent Number: 6,082,744

[45] Date of Patent: Jul. 4, 2000

[54] DOUBLE HINGED SKATE

[75] Inventors: Todd Allinger, Salt Lake City, Utah; Antonin A. Meibock, Calgary, Canada; John E. Svensson, Vashon, Wash.

[73] Assignee: K-2 Corporation, Vashon, Wash.

[21] Appl. No.: 08/957,436

[22] Filed: Oct. 24, 1997

[51] Int. Cl.[7] ..... A63C 1/00

[52] U.S. Cl. ..... 280/11.12; 36/115; 280/11.15; 280/11.27; 280/11.3

[58] Field of Search ..... 280/841, 842, 280/11.15, 11.17, 11.18, 11.22, 11.27, 11.3, 600, 615, 11.12; 36/114, 115

[56] References Cited

U.S. PATENT DOCUMENTS

| | | | |
|---|---|---|---|
| 36,244 | 8/1862 | Starr . | |
| 63,946 | 4/1867 | Sanford . | |
| 601,013 | 3/1898 | Evans . | |
| 609,401 | 8/1898 | Beisel . | |
| 1,228,544 | 6/1917 | Falstrem et al. . | |
| 1,702,316 | 2/1929 | Ridgers . | |
| 1,751,692 | 3/1930 | Frühbeis . | |
| 1,789,182 | 1/1931 | Klevstal . | |
| 2,093,915 | 9/1937 | Klevstad . | |
| 2,120,987 | 6/1938 | Murray . | |
| 2,987,834 | 6/1961 | Howe . | |
| 3,749,413 | 7/1973 | Nicolson . | |
| 4,107,856 | 8/1978 | Bourque . | |
| 4,470,205 | 9/1984 | Olivieri . | |
| 5,014,450 | 5/1991 | McGrath . | |
| 5,228,705 | 7/1993 | Merle-Smith . | |
| 5,257,793 | 11/1993 | Fortin . | |
| 5,503,413 | 4/1996 | Belogour | 280/11.27 X |
| 5,634,648 | 6/1997 | Tonel et al. . | |
| 5,842,706 | 12/1998 | Chang | 280/11.27 X |
| 5,890,724 | 4/1999 | Gignoux et al. . | |
| 5,904,359 | 5/1999 | Caeran et al. | 280/11.15 |

FOREIGN PATENT DOCUMENTS

| | | | |
|---|---|---|---|
| 0 192 312 | 8/1986 | European Pat. Off. . | |
| 0 774 282 | 5/1997 | European Pat. Off. . | |
| 0 778 058 | 6/1997 | European Pat. Off. . | |
| 0 799 629 A1 | 10/1997 | European Pat. Off. . | |
| 2642980 | 8/1990 | France . | |
| 2 659 534 | 9/1991 | France . | |
| 78733 | 1/1894 | Germany . | |
| 484530 | 10/1929 | Germany . | |
| 488768 | 12/1929 | Germany . | |
| 488740 | 1/1930 | Germany . | |
| 811095 | 7/1949 | Germany . | |
| 2527611 | 12/1976 | Germany | 280/842 |
| 35 42 251 | 6/1987 | Germany . | |
| 8702068 | 4/1989 | Netherlands . | |
| WO 96/37269 | 11/1996 | WIPO . | |
| WO 97/32637 | 9/1997 | WIPO . | |

*Primary Examiner*—Michael Mar
*Attorney, Agent, or Firm*—Christensen, O'Connor Johnson and Kindness PLLC

[57] ABSTRACT

A skate (20) hingedly attached to an elongate ice blade (24) by a frame (22). The skate having an upper shoe portion (26) adapted to receive a foot, and a sole defining a heel end, a metatarsal portion having a metatarsal head area, and a toe end. The skate further includes a midskate hinge member (12) defined the metatarsal head portion to permit the upper shoe portion to flex in the metatarsal portion, allowing the heel end to lift away from the ice blade, while the toe end remains substantially parallel with the longitudinal direction of the ice blade. The skate also includes a binding plate (23) fastened to the sole of the skate and extends from the toe end to at least behind the metatarsal head area of the sole. A mid-boot support mount (70) extends upwardly from the frame and is adapted to support the plate at a predetermined location behind the metatarsal head area of the sole to maintain the plate in a stable position as the skater pushes down on the plate and applies thrust to the ice blade. The skate also includes a forward hinge member (10) hingedly attaching the first end (54) of the plate to the ice blade, such that as the upper shoe portion hinges at the forward hinge member and about a lateral axis defined normal to the longitudinal direction of the ice blade, the mid-boot hinge member unflexes and the skater is able to push-off from the forward hinge member without the tip end of the ice blade digging into the surface it is traversing.

24 Claims, 4 Drawing Sheets

DOUBLE HINGED SKATE

FIELD OF THE INVENTION

The present invention relates generally to athletic footwear and, in particular, to an ice skate having a boot incorporating two hinges in the sole.

BACKGROUND OF THE INVENTION

Traditionally, in-line roller skates and ice skates generally include an upper shoe portion secured by a base to a frame that carries wheels or ice blades. The upper shoe portion provides the support for the skater's foot, while the frame rigidly attaches the wheels or blades to the boot. When skating on traditional skates, particularly during thrusting, difficulties are encountered in optimally and completely transferring the thrust imparted by the skater because of the frame being rigidly attached to the base of the skate, thereby decreasing the effectiveness of the thrust, as well as the comfort for the foot of the skater.

Optimally and efficiently imparting thrust to the skate during the skating stroke is especially important to speed skaters. Because of the rigid attachment of the frame to the base, speed skaters are coached not to plantarflex their ankle during the push-off phase of the stroke. The term "plantarflex" is commonly used in the art to describe the rotation of the foot relative to the leg, where the fore foot moves distally from the leg. No plantarflexion at the ankle keeps the blade flat on the ice and prevents the tip of the blade from digging into the ice, thereby causing an increase in friction and reducing the skater's speed. If, however, the skater is permitted to plantarflex his or her ankles during the skate stroke, the fore foot will be able to move distally and allow the calf muscles to generate more power during the skate stroke when compared to a stroke where plantarfilexion is prevented or discouraged. Thus, a skate that permits ankle plantarflex should allow a skater to generate more power and speed, in addition to reducing the risk of digging the blade's tip into the surface the skater is traversing.

Prior attempts at allowing ankle plantarflexion have resulted in complicated linkage mechanisms that move the instantaneous point of rotation between the boot and blade forward as the heel lifts. Such a linkage mechanism often results in a skate that is too heavy because of the multiple links. Other attempts at permitting ankle plantarflexion have used a single-hinge joint between the blade and boot, thereby hingedly connecting the blade to the boot. The hinge is located below the boot, between the metatarsal head and toe end of the boot. While a single-hinge point attachment system is lighter, current models fail to prevent medial to lateral motion of the blade relative to the boot when the heel is lifted because of a narrow hinge, thus resulting in an unstable skating stroke. Also, when the heel is lifted, the force from the boot to the blade is transferred through the hinge point. Thus, the skater cannot change the location of the center of pressure on the blade. This produces an unstable platform from which the skater can apply thrust through the blade.

An additional drawback to skates having a single hinge joint stems from the shoe portion of the skate. As briefly noted above, skates traditionally have a boot or shoe portion that has a rigid or semi-rigid base that impedes the foot from flexing at the balls of the foot during the skating motion, thereby restricting the natural movement in the foot, which occurs during locomotion, and preventing a skater from generating the maximum power from the skate stroke.

Thus, there exists a need for a skate that would permit ankle plantarflexion during a skating stroke, that is also lightweight, stable, and a boot that can allow flexion at the balls of the foot. The present invention addresses these issues to overcome the limitations currently encountered by providing a skate that has a first hinge member defined in the metatarsal head region and a second hinge member that is located substantially at the toe end of the boot, and a support member that engages the boot portion of the skate behind the metatarsal head area of the boot.

SUMMARY OF THE INVENTION

The present invention is skate boot that is hingedly attached to an elongated bearing member capable of traversing a surface. The boot has an upper shoe portion adapted to receive a foot and a sole defining a heel end, a metatarsal portion having a metatarsal head area, and a toe end. The boot further includes a first hinge member defined in the metatarsal portion thereof to permit the boot to flex in the metatarsal region while the toe end remains substantially parallel with a horizontal plane defined by the bearing member. The boot also includes a second hinge member attached to the sole of the boot, near the toe end, that hingedly attaches the boot to the bearing member. The second hinge member defines a second pivot point, such that as the boot hinges at the second hinge member and about a lateral axis defined relative to the longitudinal direction of the bearing member, the skater is able to push-off from the second hinge member. The boot also includes an elongate frame that is disposed between and attaches the sole of the boot to the bearing member.

In the preferred embodiment, the upper surface of the frame defines an upwardly projecting mid-boot mount adapted to support the boot at a predetermined location near the metatarsal head area of the sole. The preferred embodiment includes an elongate support plate having a forward end hingedly connected to the frame and a rearward end that extends at least to behind the metatarsal head area of the sole. The mid-boot mount engages the support plate near the metatarsal head area, thereby providing stable support for the support plate. In the preferred embodiment, the mid-boot mount engages the support plate behind the metatarsal head area.

In another aspect of the present invention, the first hinge member includes a heel shell and a fore foot shell. The heel shell is attached to the sole of the boot and defines a forward end and a rearward end. The toe shell is attached to the sole of the boot and defines a rearward end that is hingedly attached to the forward end of the heel shell to permit the boot to flex in the metatarsal head region of the foot, while the toe end of the boot remains substantially parallel with the longitudinal direction of the bearing member.

In an alternate embodiment, the first hinge member includes a base plate that is attached to the sole of the boot and extends between the toe and heel ends of the boot. The base plate has a natural flexing member defined therein and corresponds to the metatarsal head area of the boot. The natural flexing member permits the boot to flex in the metatarsal portion, while the toe end of the boot remains substantially parallel with the longitudinal direction of the bearing member.

The skate of the present invention provides several advantages cover skates currently available in the art. The skate of the present invention provides a first hinge member defined in the metatarsal head area of the upper shoe portion and a second hinge member that pivotally attaches the skate to the skate frame. The first and second hinge members permit the skate to flex in both the metatarsal head area and the toe area of the boot. The skate of the present invention also has the added advantage of permitting the ankle to plantarflex and the fore foot to flex during the skate stroke, thereby permitting a skater to generate more power and, thus, speed. Additionally, plantarflexion prevents the tip of the blade from digging into the ice during the skate stroke. The skate of the present invention is also lighter in weight than those currently available in the art. These advantages combine to define a skate having a double-hinge attachment design to permit skaters to plantarflex their ankle and to flex and extend their toes to generate more power and speed without the tip of the blade digging into the ice.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
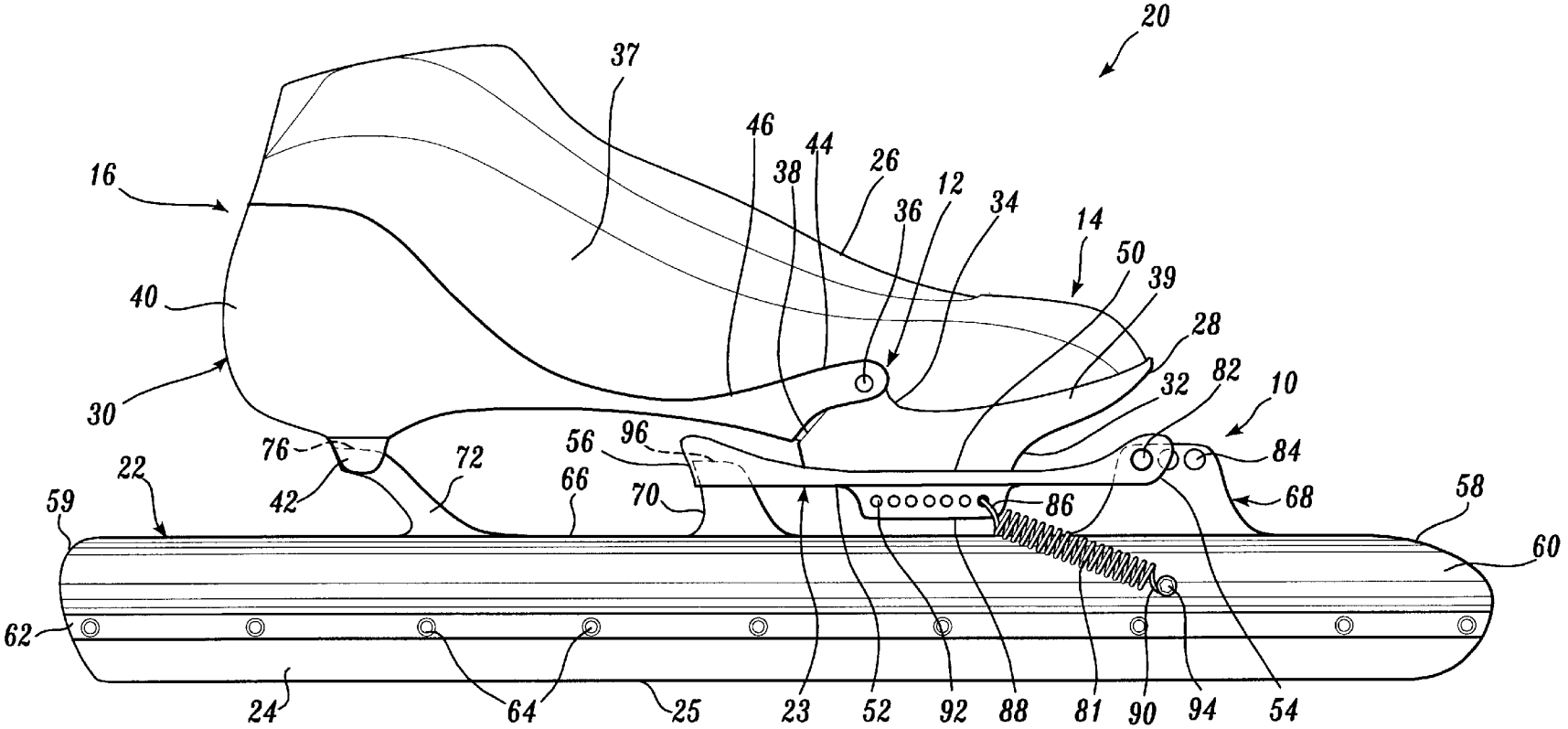
FIG. 1 is a double-hinged skate of the present invention attached to an ice blade, having a first hinge defined in the metatarsal portion of the boot and a second hinge defined substantially in the toe end of the boot.

Referring to FIG. 1, a double-hinged athletic footwear constructed in accordance with a preferred embodiment of the present invention is illustrated in the form of an ice speed skate 20. The skate 20 includes a frame 22, a forward hinge member 10, a midskate hinge member 12, and a bearing member in the form of an ice blade 24. Although the preferred embodiment of the bearing member is an ice blade 24, other types of skate bearing members capable of traversing a surface, such as an in-line roller skate, are also within the scope of the present invention.

The skate 20 includes an upper shoe portion 26 adapted to receive a foot (not shown), a fore foot base 28, and a rear foot base 30. The upper shoe portion 26 is preferably constructed from a flexible and durable natural or manmade material, such as leather or rubberized stretch nylon. The upper shoe portion 26 is fixedly attached to the fore and rear foot bases 28 and 30 by being secured beneath a last board (not shown) of the bases 28 and 30 by means well known in the art, such as glue or stitching. The upper shoe portion 26 also includes a conventional vamp and vamp closure, including a lace (not shown) or a zipper (not shown), extending along the top of the foot and from the toe area of the foot to the base of the shin of the skater. In the preferred embodiment, the upper shoe portion 26 is contoured closely to the foot of the skater for improved aerodynamics.

The fore and rear foot bases 28 and 30 are constructed in a manner well known in the art from a resilient composite material and are attached to the upper shoe portion 26 by an adhesive, such as glue. Suitable materials for the fore and rear foot bases 28 and 30 include semi-rigid fiber reinforced thermoplastic or thermo setting resins, such as carbon reinforced epoxy. Other semi-rigid or rigid materials may alternately be utilized. The forward base 28 extends from the toe end 14 of the upper shoe portion 26 to a predetermined distance behind the area of the upper shoe portion 26 that corresponds to the metatarsal head area of a received foot, hereinafter referred to as the metatarsal head area. It is preferred that the forward base 28 be molded to form a single composite structure having an upper surface (not shown) contoured to receive the fore foot of a skater and a lower surface. The lower surface has an integrally formed fore foot stem 32 depending downwardly therefrom.

The rear foot base 30, like the fore foot base 28, is preferably molded from a rigid or semi-rigid material, such as composites, having an upper surface (not shown) that is contoured to receive the heel midtarsal and metatarsal areas of a skater's foot. The rear foot base 30 includes a heel counter 40 and a heel mount 42. The heel counter 40 extends upwardly from the heel or rearward end of the rear foot base 30. The heel counter 40 surrounds and cups the heel portion 16 of the upper shoe portion 26 and provides lateral support to the heel of the skater. The heel counter 40 is preferably formed as an integral part of the rear foot base 30.

Still referring to FIG. 1, the fore and rear foot bases 28 and 30 are hingedly attached by the midskate hinge member 12. The midskate hinge member 12 is defined in the metatarsal head area of the skate 20 to permit the upper shoe portion 26 to flex about a laterally extending axis defined traversely to the longitudinal direction of the ice blade 24. In the preferred embodiment, the midskate hinge member 12 will pivot about an axis defined normal to the longitudinal direction of the ice blade 24. However, the axis of rotation of the midskate hinge member 12 is not so limited. As a non-limiting example, the rotational axis of the midskate hinge member 12 may follow the contour of the metatarsal heads of a skater's foot, thereby defining a rotational axis that is not normal to the longitudinal direction of the ice blade 24. Also, the center of rotation of the midskate hinge member 12 is defined substantially in the horizontal plane defined by the metatarsal heads of the skater's foot. Defining the center of the rotation axis at or substantially near the horizontal plane of the metatarsal heads is preferred because defining the rotational center too far below the metatarsal heads would cause the skater's foot to cramp. Therefore, in the preferred embodiment, the midskate hinge member 12 defines a rotational axis that is normal to the longitudinal direction of the ice blade 24 and has a center of rotation in the horizontal plane defined by the metatarsal heads of the skater's foot.

The midskate hinge member 12 includes a first hinge flange 34 defined on the fore foot base 28, and a first hinge arm 44 defined on the rear foot base 30. The hinge flange 34 is integrally formed from the lateral side 37 of the upper shoe portion 26, substantially near the metatarsal head area, and projects upwardly from the fore foot base 28. The hinge flange 34 includes an internally threaded bore (not shown) extending from the outside of the fore foot base 28 to partially through the thickness of the hinge flange 34. The threaded bore is adapted to threadably receive and fasten an externally threaded pivot screw 36 therein, to be described in greater detail below. A corresponding second hinge flange (not shown) and second threaded bore (not shown) are similarly formed from the medial side (not shown) of the fore foot base 28.

The toe end of the fore foot base 28 angles upwardly towards the toe end 14 of the upper shoe portion 26, so as not to interfere with the frame 22 during the skating stroke, while the rear end of the fore foot base 28, extending between the lateral and medial sides, is flat. The upper surfaces of the lateral and medial sides of the fore foot base 28, near the rearward end thereof, are angled forwardly towards the toe end 14 of the upper shoe portion 26 to define a beveled surface 38. The beveled surface 38 extends from the rear end of the fore foot base 28 to the apex (not shown) of the hinge flange 34, such that the sides of the fore foot base 28 do not interfere with the rear foot base 30 when the hinge flange 34 is hingedly attached to the first hinge arm 44.

The first hinge arm 44 is preferably formed as an integral projection of the rear foot base 30. In the preferred embodiment, the first hinge arm 44 projects forward of the metatarsal area and slightly upwards from the lateral side 46 of the rear foot base 30, so as to align adjacent with the hinge flange 34. The hinge arm 44 includes a laterally extending hole (not shown), the center of which is coaxial with the center of the threaded bore of the hinge flange 34. A pivot screw 36 is threadably received therein to pin the fore and rear foot bases 28 and 30 together, thereby defining the midskate hinge member 12. Alternate pivot mechanisms, such as a loosely received rivet (not shown) or a resilient polymeric hinge (not shown) could alternately be utilized. The hinge arm 44 is angled slightly outwards, away from the upper shoe portion 26, for proper pivotal movement between the fore and rear foot bases 28 and 30. A corresponding second hinge arm (not shown) and second hole (not shown) are similarly formed on the medial side (not shown) of the rear foot base 30. Thus, the midskate hinge member 12 hingedly connects the fore and rear bases 28 and 30 in the metatarsal head area of the skate 20 to permit the upper shoe portion 26 to hinge about a laterally extending axis defined normal to the longitudinal direction of the ice blade 24, to be described in greater detail below.

Still referring to the preferred embodiment of FIG. 1, the frame 22, suitably manufactured from aluminum or other rigid structural material, has a forward end 58, a rearward end 59, and includes an elongate tubular portion 60 and a downwardly depending flange portion 62. The flange portion 62 is integrally formed from the lower surface (not shown) of the tubular portion 60. The lower end of the flange portion 62 is bifurcated and the arms of which are spaced from each other to receive the upper end (not shown) of the ice blade 24 therebetween. The ice blade 24 is rigidly fastened within the flange portion 62 by well known fasteners 54, such as rivets or nuts and bolts.

The frame 22 also includes an attachment post 68, a midskate support post 70, and a heel support post 72. The attachment post 68 projects upwardly from the tubular portion 60 and is positioned near the forward end 58 of the frame 22, to be described in greater detail below. The midskate support post 70 projects upwardly from the tubular portion 60 at a predetermined distance behind the attachment post 68, and is located behind the metatarsal head area of the skate 20, also to be described in greater detail below.

The heel support post 72 projects upwardly from the tubular portion 60 and is positioned a predetermined distance behind the midskate support post 70. The heel support post 72 is configured as an inverted and elongate L-shaped member, with the spine of the heel support post 72 projecting upwardly from the tubular portion 60 and the base of the heel support post 72 positioned to receive the heel mount 42. The heel mount 42 is preferably shaped as an inverted U-shaped or V-shaped member and is rigidly attached beneath the heel end 16 of the skate 20 by well known fasteners (not shown), such as rivets, extending vertically through the base of the heel mount 42 and partially through the thickness of the rear foot base 30. The arms of the heel mount 42 are spaced from each other and extend downwardly to cup the heel support post 72 therein, such that the heel support post 72 supports and stabilizes the heel end 16 of the skate 20 without hindering the pivoting motion of the upper shoe portion 26 about the midskate hinge member 12. Although a combination heel support post 72 and heel mount 42 is the preferred embodiment, other single piece heel supports, such as an elongate heel mount 42 extending downwards to engage the frame 22, are also within the scope of the invention.

Still referring to the preferred embodiment of FIG. 1, the upper shoe portion 26 is hingedly attached to the frame 22 by the forward hinge member 10. The forward hinge member 10 includes a binding plate 23 and an adjustable first tension spring 81. The binding plate 23 has an upper surface 50, a lower surface 52, longitudinally spaced first and second ends 54 and 56, and is suitably manufactured from a high strength, lightweight rigid or semi-rigid material, such as aluminum or composites. The stem 32 of the fore foot base 28 is centrally received and fastened to the upper surface 50 of the binding plate 23 by fasteners well known in the art (not shown), such as rivets or nuts and bolts. Although the binding plate 23 and the fore foot base 28 are illustrated in the preferred embodiment as two separate pieces, a unibody construction, such as a binding plate 23 that is integrally formed with the fore foot base 28, is also within the scope of the invention.

In the preferred embodiment, the first end 54 of the binding plate 23 is in the shape of a U, with the attachment post 68 being releasably pinned between the arms thereof. The upper end of the attachment post 68 is fastened between the ends of the first end 54 by removable fasteners 82 well known in the art, such as a cotter pin or a screw. The fasteners 82 extend through a hole (not shown) defined through the thickness of the attachment post 68 and are received within horizontally extending holes (not shown) in the arms of the first end 54, thereby allowing the binding plate 23 to pivot about the fastener 82. Alternatively, the upper end of the attachment post 68 may be U-shaped, with a non-bifurcated first end 54 of the binding plate 23 releasably pinned therebetween, is also within the scope of the present invention.

The forward hinge member 10 is also adjustable in the longitudinal direction of the frame 22 by removing the fasteners 82 and sliding the binding member 23 either forward or rearward, relative to the forward and rearward ends 58 and 59 of the frame 22. The attachment post 68 includes a plurality of adjustment holes 84 laterally extending through the thickness thereof. The adjustment holes 84 allow the skater to adjust the position of the forward hinge member 10 relative to the forward and rearward ends 58 and 59 of the frame 22, thereby optimizing the skater's position on the frame 22. The fasteners 82 may then be reinserted, thereby locking the forward hinge member 10 into the desired location.

The upper shoe portion 26 is selectively adjustable between the lateral and medial sides of the frame 22. In the preferred embodiment, the binding plate 23 has at least one slot (not shown) extending between the lateral and medial sides thereof. The toe end 14 of the upper shoe portion 26 has at least one adjustment hole (not shown) extending vertically through the sole (not shown) and the fore loot stem 32. The position of the upper shoe portion 26 may be laterally adjusted between the lateral and medial sides of the frame 22 and locked into the desired position by well known fastening means, such as a screw, extending through the hole and received within the slot of the binding plate 23.

The tension spring 81 has a first end 86 that is releasably attached to an elongate first flange 88 disposed from the lower surface 52 of the binding plate 23 and a second end 90 that is attached to the lateral side of the frame 22. The second end 90 of the spring 81 is secured to the frame 22 by an arm 94 that projects outwardly from the lateral side of the frame 22. The second end 90 of the spring 81 is coiled around a groove (not shown) defined about the perimeter of the free end of the arm 94, thereby fastening the second end 90 to the frame 22. The first flange 88 is centrally located between the first and second ends 54 and 56 of the binding plate 23 and extends downwardly from the lateral side of the binding plate 23. The tip (not shown) of the first end 86 of the spring 81 is fastened to the flange 88 by extending the tip through one of a plurality of tensioning holes 92 extending through the thickness of the flange 88, and fastening the tip therein by well known fasteners. Although two tension springs is the preferred embodiment, a single spring centrally located between the lateral and medial sides of the frame 22 and extending to the underside of the binding plate 23, is also within the scope of the invention.

The degree of tension applied to the binding plate 23 by the spring 81 may be adjusted. By removing the first end 86 of the spring 81 from the tensioning hole 92 and pulling the first end 86 either forward or rearward, relative to the first and second ends 54 and 56 of the binding plate 23, and refastening the first end 86 into a different hole 92, the amount of tension may be increased or decreased. A corresponding second tension spring (not shown) and second arm (not shown) are similarly formed on the medial side (not shown) of the frame 22, such that first and second springs are adjustably fastened to both the lateral and medial sides of the skate 20. Thus, as fastened to the flange 88 and the arm 94, the spring 81 tensions the binding plate 23 into a closed position, wherein the second end 56 is urged downwardly against the midskate support post 70. Other biasing mechanisms, such as coil springs received on the fasteners 82 for hinged engagement with the binding plate 23 and frame 22, may alternately be utilized within the scope of the present invention.

As briefly noted above, the midskate support post 70 projects upwardly from the upper surface 66 of the frame 22. The midskate support post 70 is located substantially midway between the forward and rearward ends 58 and 59 of the frame 22. The upper surface 96 of the midskate support post 70 is adapted to receive and support the second end 56 of the binding plate 23. In the preferred embodiment, the upper surface 96 is sized to be insertably received within a cavity (not shown) defined within the second end 56 of the binding plate 23, such that the second end 56 acts as a cap extending over the midskate support post 70. The cavity longitudinally extends within the second end 56 for a predetermined distance, such that when the forward hinge member 10 is adjusted along the attachment post 68, the second end 56 is slidable over the upper surface 96 of the midskate support post 70. Although it is preferred that the midskate support post 70 be insertably received within the second end 56 of the binding plate 23, other configurations are also within the scope of the invention. As a non-limiting example, the midskate support post 70 may be configured as an inverted Y-shape member projecting upwardly from the upper surface 66 and is sized such that the second end 56 of the binding plate 23 is received between the upwardly projecting arms of the midskate support post 70 and is seated in the arcuate portion thereof. As another non-limiting example, the midskate support post 70 may be eliminated altogether and the binding plate 23 may be extended along the sole to the heel portion 16, where it is received and supported by the heel support post 72.

While the shape of the midskate support post 70 is not important to the invention, the location of the midskate support post 70 relative to the upper shoe portion 26 is. Preferably, the midskate support post 70 is located behind the metatarsal head area of the upper shoe portion 26. However, in some versions of the invention it may be desirable to locate the midskate support post 70 slightly ahead of metatarsal head area, such that it engages the upper shoe portion 26 substantially near the vertical plane defined by the metatarsal head area of the upper shoe portion 26.

Locating the midskate support post 70 and supporting the binding plate 23 behind the metatarsal head area improves the efficiency of a skater's stroke because the skater can freely flex his or her foot at the midskate hinge member 12. By permitting skaters to plantarflex their foot, the skater is able push-off from the fore foot base 28, thereby intensifying the energy applied to the skate blade 24 during the skating stroke. Furthermore, by locating the midskate support post 70 and supporting the binding plate 23 behind the metatarsal head area, the midskate support post 70 and the binding plate 23 act in unison to provide skaters with a firm and stable platform from which to plant their fore foot and push-off. Catapulting would occur when the foot goes from a flexed position (heel in air, midskate on the midskate support post 70) to an extended position (heel in air, midskate off midskate support post 70 and boot extended).

Figure 2:
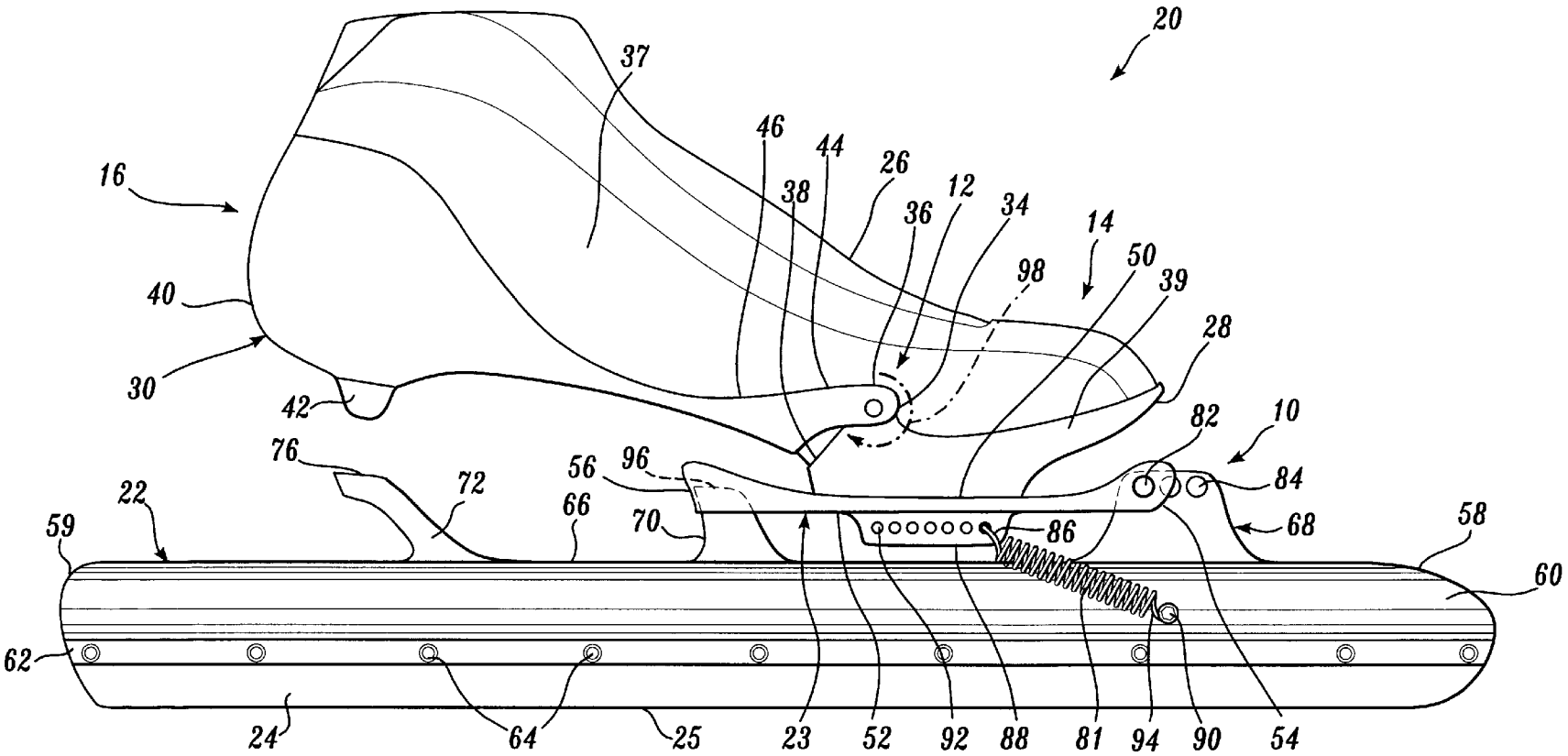
FIG. 2 is a side view of the double-hinged skate of the present invention with the boot flexed around the first hinge member to lift the heel end of the boot from the frame of the ice blade and the foot balancing on the forward portion of the foot from the metatarsal heads forward.
Figure 3:
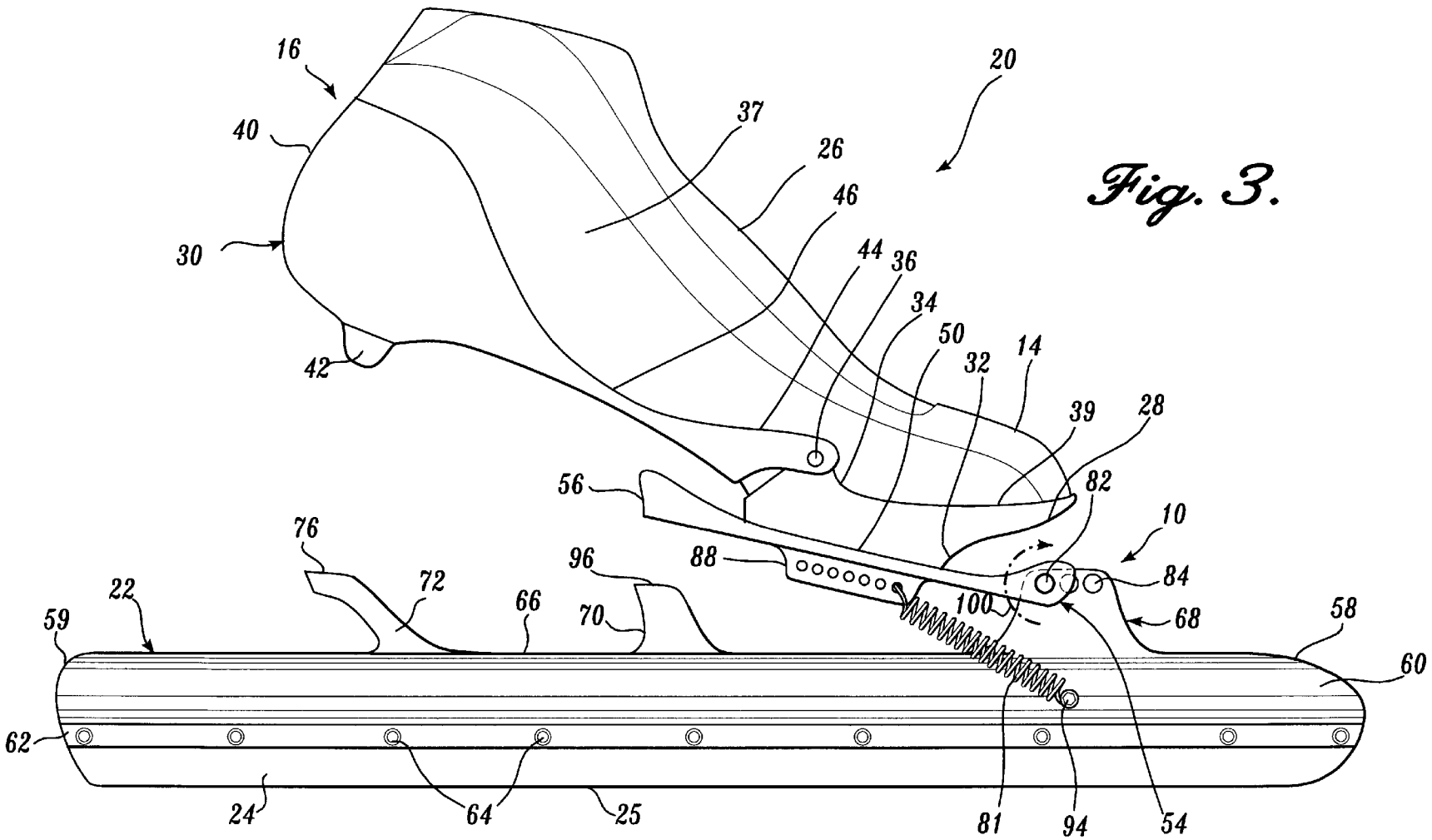
FIG. 3 is a side view of the double-hinged skate of the present invention with the boot pivoting about the second hinge member, with the metatarsal head portion of the boot and first hinge member straightening out, thereby allowing maximum extension of the leg.

Operation of the skate 20 of the present invention may be best understood by referring to FIGS. 1–3. Generally, a skating stroke may be best described as having at least three distinct phases; a glide phase, a push-off phase, and a recovery phase.

The glide phase is seen in FIG. 1. During the glide phase, the skate 20 of the present invention, the lower surface 25 of the ice blade 24 is capable of traversing an ice surface (not shown). The midskate and forward hinge members 12 and 10 are unflexed, and the heel support post 72 and the midskate support post 70 are seated within the heel mount 42 and second end 56 of the binding plate 23, respectively. During the glide phase, the weight of the skater is supported by blade 24 as it is traversing the ice.

The push-off phase of the skating stroke may be best understood by referring to FIGS. 2 and 3. As the skater enters the push-off phase of the skating stroke, the skater begins to plantarflex his or her ankle and flex his or her foot about the midskate hinge member 12, thereby rotating the upper shoe portion 26 in a clockwise direction about the pivot screw 36, and as indicated by the arrow 98. As the upper shoe portion 26 pivots about the pivot screw 36, the skater lifts the heel end 16 of the upper shoe portion 26 from the frame 22, separating the heel mount 42 from the heel support post 72. Although the heel end 16 is separated from the frame 22, the toe end 14 of the skate 20 remains parallel with the longitudinal direction of the ice blade 24 and the entire length of the lower surface 25 of the ice blade 24 remains in full contact with the ice surface. During this initial part of the push-off phase, the skater's foot pivots at the metatarsal heads of the foot and the weight of the skater bears down on the forward base 28. As the skater bears down on the forward base 28, the midskate support post 70 and the binding plate 23 support the loads and provides the skater with a stable platform from which the skater is able to propel his or herself forward.

As the skater continues to plantarflex the ankle, thereby lifting the heel end 16 further from the frame 22, the skater transitions into the final part of the push-off phase, as seen in FIG. 3. During this part of the push-off phase, the skater further extends the leg, plantarflexes the ankle, but now extends the foot so the heel portion 16 rotates counterclockwise relative to the fore foot. This motion lifts the second end 56 from the midskate support post 70 and rotating the upper shoe portion 26 in a clockwise direction about the fastener 82, and as indicated by the arrow 100. The entire length of the lower surface 25 of the ice blade 24 remains in contact with the ice surface during the final part of the push-off phase of the skating stroke. During the recovery phase of the skating stroke, the lower surface 25 of the blade 24 is no longer in contact with the ice. The tension spring 81 returns the binding plate 23 to the midskate support post 70. The boot spring returns the rear and fore foot sections of the boot to their gliding position with the heel mount 42 in contact with the heel support post 72. The forward and midskate hinge members 10 and 12 permit the skater to plantarflex his or her ankles during the push-off phase of the skating stroke, thereby permitting the calf muscles to fully extend and generate greater speed, as well as reducing the risk of digging the tip end of the blade 24 into the ice.

Figure 4:
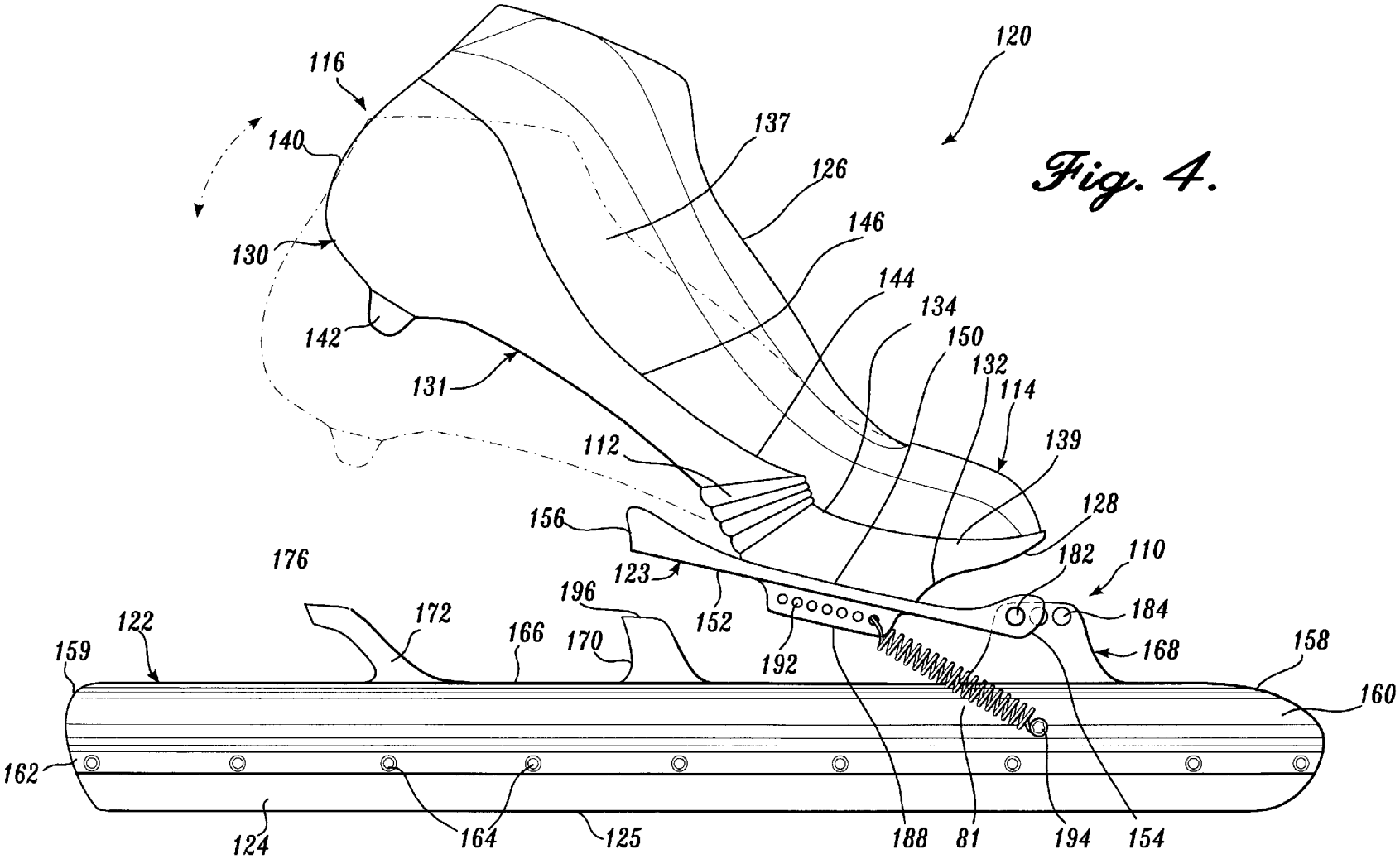
FIG. 4 is a side view of an alternate embodiment of the double-hinge skate of the present invention, showing the first hinge member as an integral flexing member to permit the metatarsal head area of the boot to freely flex.

Although mechanically pinning the hinge arm 144 to the hinge flange 134 is the preferred embodiment for the midskate hinge member 112, as seen in FIG. 4, alternate embodiments of the midskate hinge member 112 are also within the scope of the invention. As seen in FIG. 4, the midskate hinge member 112 may be configured as a composite or elastomeric hinge. In this alternate embodiment, the skate 120 includes a single piece base 131 or multipiece assembly extending from the toe end to the heel end of the upper shoe portion 126. Integral with the base 131, and defined in the metatarsal head area of the upper shoe portion 126, is the midskate hinge member 112. The midskate hinge member 112 is formed from a composite or elastomeric material and extends from the lateral side of the base 131, along the sole (not shown) of the base 131, and upwardly along the medial side (not shown) of the base 131. The composite midskate hinge member 112 is formed as a resilient bellows-type joint and becomes loaded when flexing during the push-off phase of the skating stroke, and it releases to return to its natural position during the recovery phase. The skate 120 of FIG. 4 is identical in construction and use as described above for the preferred embodiment.

The previously described versions of the present invention provide several advantages over skates currently available in the art. The skate of the present invention provides a midskate hinge member defined in the metatarsal head area of the upper shoe portion and a forward hinge member that pivotally attaches the skate to the skate frame. The midskate and forward hinge members permit the skate to flex in both the metatarsal head area and the toe area of the boot. This allows a natural motion of the lower limb segments during skating while providing stable control of the blade. The skate of the present invention also has the added advantage of permitting the ankle to plantarflex during the skate stroke, thereby permitting a skater to generate more power and, thus, speed. Additionally, this skate prevents the tip of the blade from digging into the ice during ankle plantar flexion of the skate stroke. The skate of the present invention is also lighter in weight than those currently available in the art. Thus, these advantages combined to define a skate having a double-hinge attachment design to permit skaters to plantarflex their ankle to generate more power and speed without the tip of the blade digging into the ice. While described herein in the preferred embodiment of an ice skate, the present invention can be readily adapted based on the disclosure contained herein for an in-line roller skates.

From the foregoing description, it may be seen that the skate of the present invention incorporates many novel features and offer significant advantages over those currently available in the art. It will be apparent to those of ordinary skill that the embodiments of the invention illustrated and described herein are exemplary only. As a first non-limiting example, the forward and rearward bases 28 and 30 of the preferred embodiment may be replaced with a single or two plates (embedded into the sole of the upper shoe portion 26. In this non-limiting example, the midskate hinge member 12 would be defined in the sole of the upper shoe portion, in the metatarsal head area thereof. As a second non-limiting example, and although it is preferred that the frame 22 is formed as a single structure, a split frame and bearing member having a first section hingedly attached to the toe end 14 of the upper shoe portion 26 and a second end rigidly attached to the heel position 16, such that the second end hinges with the heel portion 16 during use, is also within the scope of the invention. Therefore, changes may be made to the foregoing embodiments while remaining within the spirit and scope of the present invention.

The embodiments of the invention in which an exclusive property or privilege is claimed are defined as follows:

1. A skate boot hingedly attached to an elongate skate bearing member having a forward and rearward portion, the boot having an upper shoe portion adapted to receive a foot, a medial side, a lateral side, and a sole defining a heel end, a metatarsal portion having a metatarsal head area, and a toe end, wherein the boot further comprises:

(a) a first hinge member located between a substantially rigid forward sole portion and a substantially rigid rearward sole portion, the first hinge member being connected between the forward and rearward sole portions to permit the boot to flex in the metatarsal portion while the toe end remains substantially parallel with a horizontal plane defined by the bearing member and to permit at least a portion of the heel end to be moved into a raised position relative to the rearward portion of the skate bearing member; and (b) a second hinge member defined in the sole of the boot near the toe end that hingedly attaches the boot to the bearing member, such that the boot is capable of hinging at the second hinge member and about a lateral axis defined relative to the longitudinal direction of the bearing member to permit at least a portion of the toe end to be moved into a raised position relative to the skate bearing member and to permit the user to push-off from the second hinge member.

2. The boot of claim 1, further comprising an elongate frame having an upper surface and a lower surface, wherein the frame is disposed between and attaches at least the toe end of the sole of the boot to the bearing member.

3. The boot of claim 2, wherein the upper surface of the frame defines an upwardly projecting mid-boot mount adapted to support the boot at a predetermined location near the metatarsal head area of the sole and provide stable support to the boot as the boot hinges about the first hinge member.

4. The boot of claim 3, wherein the second hinge member further comprising an elongate support plate having an upper surface, a forward end hingedly attached to the frame, and a rearward end that extends to at least behind the metatarsal head area, wherein the upper surface of the support plate is adapted to receive the sole of the boot.

5. The boot of claim 4, wherein the mid-boot mount engages the support plate at a predetermined location behind the metatarsal head area of the sole to maintain the support plate in a stable position as the user of the boot pushes down on the support plate and applies thrust to the bearing member.

6. The boot of claim 5, further comprising biasing means having a first end fastened to the frame and a second end fastened to the support plate to urge the support plate against the mid-boot support mount.

7. The boot of claim 6, wherein the biasing means is adjustable along the length of the support plate.

8. The boot of claim 7, wherein the biasing means comprises first and second springs mounted on opposite sides of the frame and pinned to sides of the support plate.

9. The boot of claim 8, wherein the second hinge member further comprises an adjustment portion extending between the bearing member and the bearing member to allow slideable adjustment of the second hinge member in the longitudinal direction of the bearing member.

10. The boot of claim 9, wherein the bearing member comprises at least a first ice blade.

11. The boot of claim 3, wherein the upper surface of the frame defines an upwardly projecting heel mount adapted to support the sole of the boot in the heel end thereof.

12. The boot of claim 3, wherein the first hinge member comprises a heel shell, wherein the heel shell is attached to the sole of the boot and defines a forward end and a rearward end.

13. The boot of claim 12, wherein the first hinge member further comprises a toe shell, wherein the toe shell is attached to the sole of the boot and defines a rearward end that is hingedly attached to the forward end of the heel shell to permit the boot to flex in the metatarsal head area of the sole, while the toe end of the boot remains substantially parallel with the longitudinal direction of the bearing member.

14. The boot of claim 1, wherein the first hinge member comprises a heel shell, wherein the heel shell is attached to the sole of the boot and defines a forward end and a rearward end.

15. The boot of claim 14, wherein the first hinge member further comprises a toe shell, wherein the toe shell is attached to the sole of the boot and defines a rearward end that is hingedly attached to the forward end of the heel shell to permit the boot to flex in the metatarsal head area of the sole, while the toe end of the boot remains substantially parallel with the longitudinal direction of the bearing member.

16. The boot of claim 3, wherein the first hinge member comprises a base shell attached to the sole of the boot and extending between the toe and heel ends and partially up the lateral and medial sides of the boot.

17. The boot of claim 1, wherein the first hinge member comprises a base shell attached to the sole of the boot and extending between the toe and heel ends and partially up the lateral and medial sides of the boot.

18. The boot of claim 16, wherein the base plate comprises a natural flexing member integral with the base plate and defined in the metatarsal head area of the sole to permit the boot to flex in the metatarsal portion while the toe end thereof remains substantially parallel with the longitudinal direction of the bearing member.

19. The boot of claim 18, wherein the natural flexing member is a resilient hinge and extends from the lateral side, along the sole, and to the medial side of the boot, and the resilient hinge becomes preloaded when flexing and releases to return to its natural position.

20. A skate boot hingedly attached to an elongate bearing member having a tip end and capable of traversing a surface, the boot having an upper shoe portion adapted to receive a foot, a medial side, a lateral side, and a sole defining a heel end, a metatarsal portion having a metatarsal head area, and a toe end, wherein the boot further comprises:

(a) a first hinge member defined in the metatarsal portion of the boot to permit the boot to flex in the metatarsal portion, allowing the heel end of the sole to lift from the bearing member while the toe end remains substantially parallel with the longitudinal direction of the bearing member;

(b) an elongate plate fastened to the sole of the boot and extending from the toe end to at least behind the metatarsal head area of the sole, the plate having a forward end and a rearward end;

(c) a mid-boot support mount extending upwardly from the bearing member and adapted to support the plate at a predetermined location near the first hinge member and maintain the plate in a stable position as the skater pushes down on the plate and applies thrust to the bearing member; and (d) a second hinge member hingedly attaching the forward end of the plate to the bearing member, such that as the boot hinges at the second hinge member and about a lateral axis defined relative to the longitudinal direction of the bearing member, so that the user is able to push-off from the second hinge member.

21. The boot of claim 20, wherein the first hinge member is an elastomeric hinge extending from the lateral side, along the sole, to the medial side of the boot, the elastomeric hinge becomes loaded when hinging and releases to return to its natural position.

22. The boot of claim 21, further comprising biasing means having a first end fastened to the plate and a second end fastened to the bearing member to urge the plate against the mid-boot support mount.

23. The boot of claim 22, wherein the second hinge member comprises an adjustment member extending between the second hinge member and the bearing member to slideably adjust the second hinge member along the longitudinal direction of the bearing member.

24. A skate, comprising:

(a) a boot having an upper shoe portion adapted to receive a foot and a sole defining a heel end, a metatarsal portion having a metatarsal head area, and a toe end;

(b) at least a first elongate skate bearing member having a tip end and capable of traversing a surface and having a first end hingedly attached to the sole of the boot;

(c) a first hinge member defined in the metatarsal portion of the boot to permit the boot to flex in the metatarsal portion, allowing the heel end of the sole to lift from the bearing member while the toe end remains substantially parallel with the longitudinal direction of the bearing member;

(d) an elongate plate incorporated with the sole of the boot and extending from the toe end to at least behind the metatarsal head area of the sole, the plate having a forward end and a rearward end;

(e) a mid-boot support mount extending upwardly from the bearing member and adapted to support the plate at a predetermined location behind the metatarsal head area of the sole and to maintain the plate in a stable position as the skater pushes down on the plate and applies thrust to the bearing member; and (f) a second hinge member defined in the sole of the boot near the toe end and hingedly attaching the boot to the first bearing member, such that as the boot hinges at the second hinge member and about a lateral axis defined normal to the longitudinal direction of the first bearing member, the first hinge member unflexes and the user is able to push-off from the second hinge member without the tip end of the bearing member digging into the surface it is traversing.

* * * * *

UNITED STATES PATENT AND TRADEMARK OFFICE

CERTIFICATE OF CORRECTION

PATENT NO. : 6,082,744

DATED : July 4, 2000

INVENTOR(S) : T. Allinger et al.

It is certified that error appears in the above-identified patent and that said Letters Patent is hereby corrected as shown below:

| COLUMN | LINE | |
|---|---|---|
| 11 (Claim 9, | 11 line 3) | "the bearing member and" should read --the second hinge member and-- |

Signed and Sealed this

Eighth Day of May, 2001

*Attest:*

Nicholas P. Godici

NICHOLAS P. GODICI

*Attesting Officer*

*Acting Director of the United States Patent and Trademark Office*